US006648692B1

(12) United States Patent
Gillrath et al.

(10) Patent No.: US 6,648,692 B1
(45) Date of Patent: Nov. 18, 2003

(54) ZERO SPACE FUSE SYSTEM

(75) Inventors: Elmar Gillrath, Wauwatosa, WI (US); Randy Pohl, Mukwonago, WI (US); Darrell S. Filtz, Cedarburg, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 10/261,278

(22) Filed: Sep. 30, 2002

(51) Int. Cl.[7] ..... H01R 13/68
(52) U.S. Cl. ..... 439/621; 439/716; 361/833
(58) Field of Search ..... 439/621, 716, 439/622, 620; 337/33; 361/41, 833

(56) References Cited

U.S. PATENT DOCUMENTS 4,968,269 A * 11/1990 Urani et al. ..... 439/622
5,515,023 A * 5/1996 Marach et al. ..... 337/213
5,616,054 A * 4/1997 Quinlan ..... 439/621

* cited by examiner

*Primary Examiner*—Dean A. Reichard
*Assistant Examiner*—Jinhee J Lee
(74) *Attorney, Agent, or Firm*—Quarles & Brady; Alexander M. Gerasimow; William R. Walbrun

(57) ABSTRACT

An in-plane fuse adapter provides a conductive extension that may be received by a standard terminal of a terminal block relay or the like to present side surfaces conforming substantially to the width of the terminal block relay allowing other terminal blocks to be closely abutted to the left and right side of the terminal block relay when it is attached to a connector rail. A wire terminal is held by the housing and attached to the second socket positioned to receive and retain an external electrical conductor of a type normally received by the plurality of terminals of the terminal block relay.

15 Claims, 2 Drawing Sheets

FIG. 3
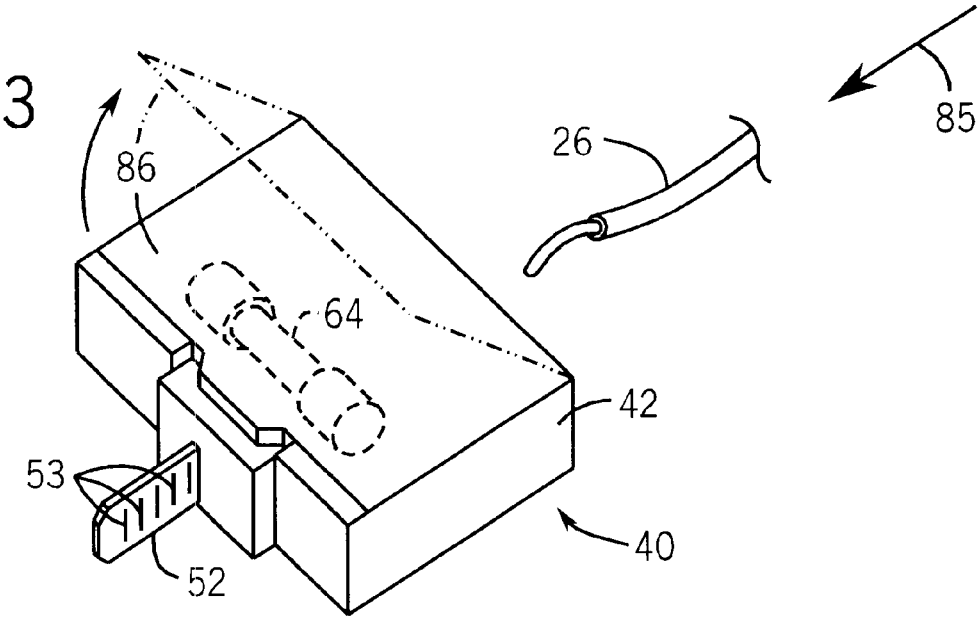
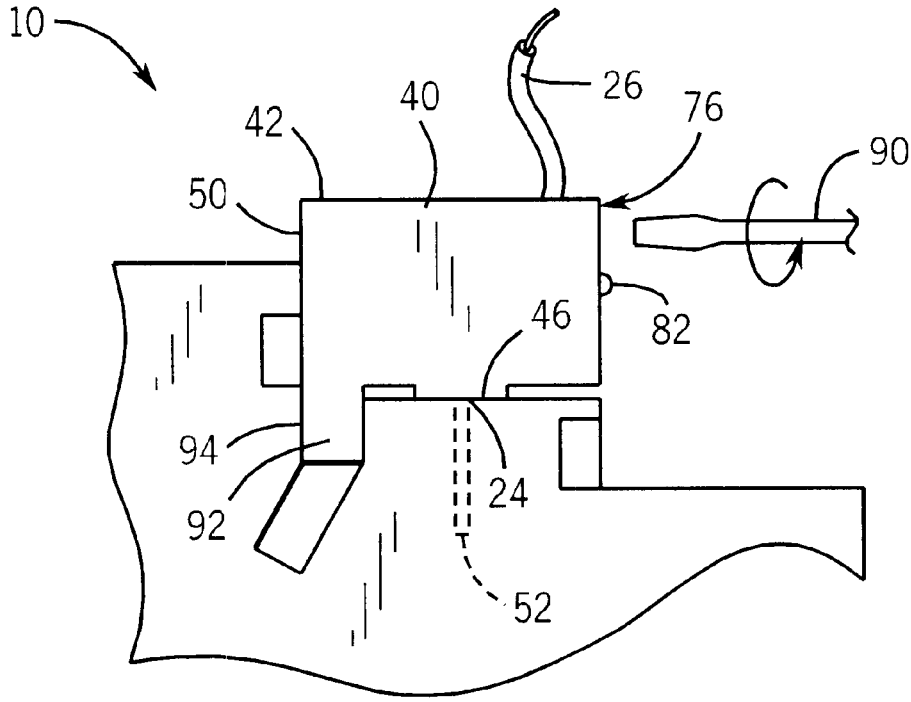
FIG. 4

ZERO SPACE FUSE SYSTEM

CROSS-REFERENCE TO RELATED APPLICATIONS

STATEMENT REGARDING FEDERALLY SPONSORED RESEARCH OR DEVELOPMENT

BACKGROUND OF THE INVENTION

The present invention relates to narrow-profile, terminal block relays and in particular to a method of adding electrical fuses to such relays.

"European style" terminal blocks provide a method of electrical interconnection of industrial control components. These terminal blocks have a narrow and flat shape that allows them to be stacked together in close proximity when mounted on a DIN rail. When so stacked, wires may be received at terminals along the upper and lower edge of the terminal blocks.

The terminals allow connection to other wires connected to other terminals or to the leads of electrical components supported by the terminal block. Such electrical components may include fuses, indicator lights, and relays.

For a terminal block holding a relay ("a terminal block relay") or a fuse ("a terminal block fuse"), the relay or fuse is typically received by a socket at the front edge of the terminal block. The housings holding the relay or fuse are designed to have a width no greater than that of the terminal block, typically between 5 to 14 mm, to minimize space occupied on the DIN rail.

Programmable logic controllers (PLCs) are industrial computers used for the control of machines and processes. A PLC has input and output circuits that may connect to sensors and actuators on controlled machines and by executing a standard control language, such as relay ladder language, the PLC may read the inputs and according to the execution of the control program, provide outputs controlling the machine.

Terminal block relays are often used with a PLC, the latter which may be attached to the same DIN mounting rail on which the terminal block relays are mounted. Outputs from the PLC are connected to the coils of terminal block relays whose contacts in turn connect to the desired machine actuator to provide a form of isolation.

When the contacts of a terminal block relay are connected, for example, to an inductive load, a fuse may be placed in series with those contacts. This normally entails placing a fuse terminal block adjacent to each terminal block relay doubling the required space needed on the mounting rail. When many outputs to inductive loads are required, the amount of space on the rail is quickly exhausted.

SUMMARY OF THE INVENTION

The present invention provides a fuse adapter for adding a fuse to a terminal block relay without using additional space on the mounting rail. The fuse adapter also minimizes the wiring required to add a fuse to a terminal block relay.

Generally, the fuse adapter has a narrow housing holding a fuse and providing a conductive extension that may engage a terminal of the terminal block relay to mechanically and electrically fix the fuse adapter to the terminal block. When so fixed, the fuse adapter lies within the width of the terminal block relay so as not to interfere with adjacent terminal blocks. The fuse adapter provides an additional terminal that may receive a wire to connect the internal fuse in series between the received wire and the conductive extension. The fuse adapter also has the benefit of allowing the fuse to be replaced in the future, by providing a means of entry to the fuse adapter in the event it 'open" or warrants replacement in the circuit.

Specifically then, the present invention provides an in-plane fuse adapter for use with a terminal block relay, the terminal block relay being of a type mountable at its rear surface on a laterally extending rail to present a substantially constant lateral thickness between left and right planar walls each which may abut corresponding planar walls of adjacent terminal blocks mounted on the rail. The terminal block relay may provide a plurality of terminals accessible at upper and lower edges of the terminal block relay for receiving electrical connectors communicating electrical signals to a relay of the terminal block relay.

The fuse adapter comprises an insulating housing supporting a fuse holder within the housing. The fuse holder has a first and second socket receiving corresponding ends of a standard electrical fuse.

The fuse 64 may be replaced by prying it away from the sockets 60 and 66, which provide a spring clamping through their metallic elements.

A conductive extension is connected at a first end within the housing to the first socket. A second end of the conductive extension extends from the housing in an engagement direction so that it may be received and retained by a terminal of the terminal block relay. A wire terminal is supported by the housing and attached to the second socket so that it may receive and retain an external electrical conductor of a type normally received by the terminals of the terminal block relay. When the conductive extension is retained by a terminal of the terminal block relay, the housing lies substantially between planes of the left and right planar walls of the terminal block relay.

Thus, it is one object of the invention to provide a method of adding a fuse to a terminal block relay without using additional space along the mounting rail.

It is yet another object of the invention to provide a method of adding a fuse to a terminal block relay that reduces the number of terminal connections that must be made and eliminates a jumper. The present invention requires only two terminal attachments compared to three terminal attachments required when a jumper is used between a terminal block fuse and a terminal block relay.

It is yet another object of the invention to provide a convenient system for isolating outputs of programmable logic controllers using fuses and relays.

When the conductive extension is attached to a conventional terminal block relay, the left and right walls of the housing of the in-plane fuse adapter may be co-planar with the left and right planar walls of the terminal block relay.

Thus, it is another object of the invention to provide an assembled unit that retains substantially planar left and right walls minimizing areas that could catch debris or interfere with wiring operations.

The housing of the fuse adapter may include at least two retention surfaces that are not parallel to each other and that abut corresponding surfaces of the terminal block relay to resist torsion of the fuse adapter when it is installed in the terminal block relay. Alternatively or in addition, the housing of the fuse adapter may include a key portion fitting within a corresponding keyway of the terminal block relay to resist torsion of the fuse adapter with respect to the terminal block relay.

Thus, it is an object of the invention to provide a fuse adapter providing improved mechanical termination of a connecting wire.

The wire terminal may be positioned in the housing of the fuse adapter to receive an external electrical conductor along the engagement direction.

Thus, it is another object of the invention to allow wiring of the terminal block along the same axis and in a manner similar to that which would be used without the fuse adapter.

The wire terminal may operate to releasably retain the electrical conductor and in one embodiment, may be a screw and clamp terminal.

Thus, it is another object of the invention to preserve the benefits of being able to rewire the terminal block relay.

The extension may include a surface embossment.

It is therefore another object of the invention to provide increased mechanical retention of the fuse adapter as well as electrical connection.

The housing of the fuse adapter may include a door, or a hinged lever, providing access to the fuse holder.

It is thus another object of the invention to allow the fuse to be replaced without affecting the mechanical integrity of the connection between the wire and the terminal block relay.

The first and second socket of the fuse holder may be opposed about an access perpendicular to the extension direction and parallel to the left and right planar wall of the terminal block relay when the conductive extension is retained by a terminal of the terminal block relay.

Thus, it is another object of the invention to accommodate standard glass fuses without unduly increasing the cantilever of the fuse adapter.

The substantially constant lateral thickness of the terminal block is in most cases 6.2 mm.

Thus, it is another object of the invention to provide a system that works with standard European-type terminal blocks.

The fuse adapter may include an indicator lamp connected electrically in parallel with the sockets to light when the fuse is absent or open. The lamp may be an LED or neon and may be exposed through the housing along a front edge of the housing away from the rail when the conductive extension is retained by a terminal of the terminal block relay.

Thus, it is another object of the invention to provide a fuse adapter that provides features normally found in a terminal block fuse.

These particular objects and advantages may apply to only some embodiments falling within the claims and thus do not define the scope of the invention.

BRIEF DESCRIPTION OF THE DRAWINGS

FIG. 3 is a perspective view of the fuse adapter of FIG. 2 showing the orientation of the fuse in phantom and the opening of a door for replacing the fuse without mechanical disconnection of an external wire; and FIG. 4 is a fragmentary, side elevational view of the terminal block relay of FIG. 1 (inverted with respect to FIG. 1) with the fuse adapter attached to terminal of the terminal block relay and showing the abutment of two surfaces of the fuse adapter to resist torsion and further showing the use of a key received in a keyway of the fuse adapter to provide increased mechanical stability and showing the forward facing screw terminal and indicator lamp.

DETAILED DESCRIPTION OF THE PREFERRED EMBODIMENT

Figure 1:
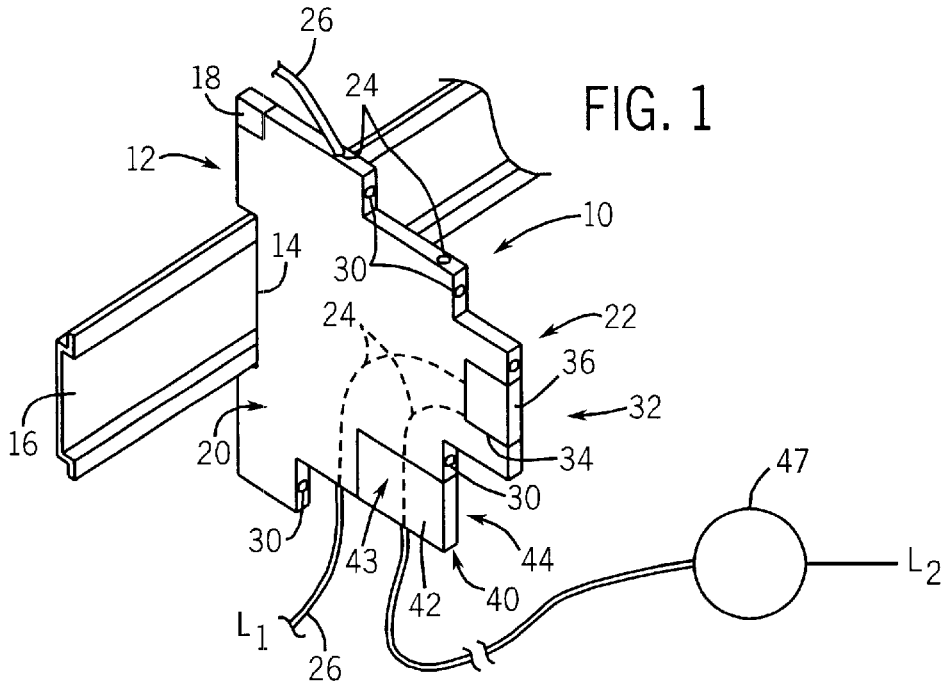
FIG. 1 is a perspective view of a standard terminal block relay mounted at its rear on a DIN rail (inverted from normal mounting to show the latching mechanism) with the fuse adapter of the present invention attached at a lower edge.

Referring now to FIG. 1, a standard terminal block relay 10 may include a rear surface 12 having a channel 14 for receiving a DIN rail 16. Left side 20 and right sides 22 of the terminal block relay 10 are substantially planar so as to abut corresponding left or right sides of other similar terminal blocks that may also be placed on the DIN rail 16 and stacked together against the terminal block relay 10 with no wasted space. The terminal block relay 10 may be releasably retained on the DIN rail 16 by operation of a catch (not shown) retractable by a slide 18.

The upper and lower edges of the terminal block relay 10 support terminals 24, such as screw terminals, for receiving and electrically connecting to wires 26, free from interference from adjacent terminal blocks.

The front edge 32 of the terminal block relay 10 includes a socket 34 holding a narrow profile electrical relay 36 whose left and right sides are coplanar with left side 20 and right side 22 of the terminal block relay 10, and whose front edge is flush with the front edge 32 of the terminal block relay 10, the relay 36 may be removed from the terminal block relay 10 for repair or to change the relay type as may be desired.

As is understood in the art, contacts and coil of the relay 36 are connected through the socket 34 to the various ones of the terminals 24 via conductors internal to the terminal block relay 10. The terminal block relay 10 thus providing a simple method of connecting to the relay 36 mechanically and electrically.

Terminal block relays 10 of this kind ,may be commercially purchased from a variety of vendors including the Allen-Bradley brand from Rockwell Automation of Milwaukee, Wis.

According to the present invention, a fuse adapter 40 may be attached at one of the terminals 24 of the terminal block relay 10. Generally, the fuse adapter 40 allows a fuse to be incorporated into the circuit of the relay 36 of the terminal block relay 10 so that a first external wire 26 from a line source $L_1$ (possibly connected through shutoff switches and the like), may connect to one side of the terminal block relay 10 and, via internal conductors, to a contact of the relay 36. A return from the contact of the relay 36 may pass through other internal conductors to a terminal 24 of the terminal block relay 10 and then through the fuse adapter 40 containing a fuse (not shown). From the fuse adapter 40, the conductive path may proceed to an inductive load 47 to return to the remaining side of the line $L_2$.

Figure 2:
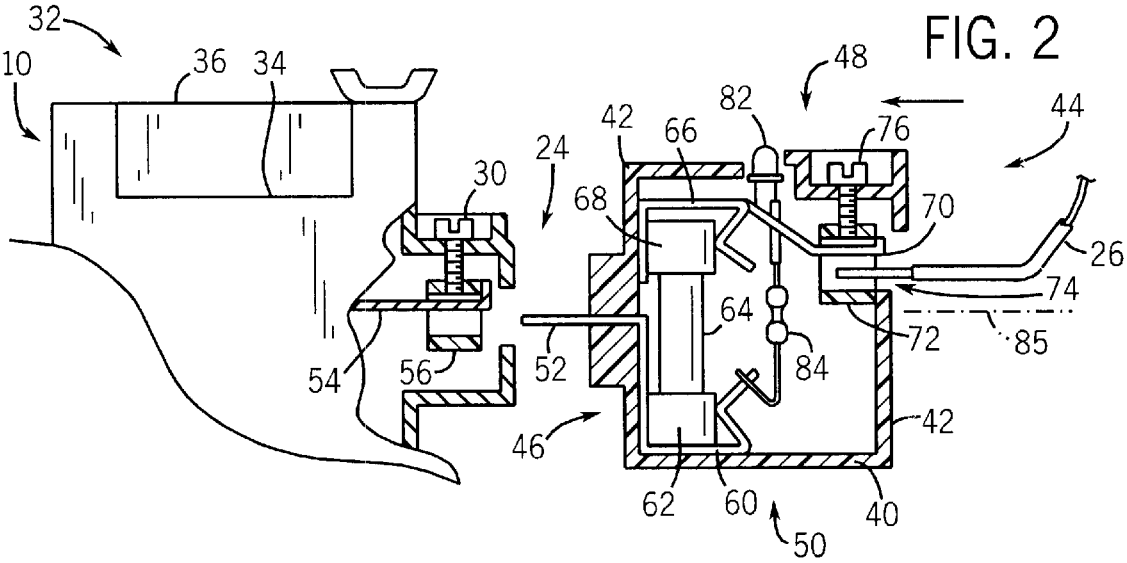
FIG. 2 is an exploded view of the fuse adapter and terminal block relay of FIG. 1 rotated by 90 degrees and in partial cross-section showing a conductive extension of the fuse adapter received by a screw terminal of the terminal block relay to provide mechanical and electrical connection to the terminal block relay, and showing a screw terminal, internal fuse, and indicator lamp of the fuse adapter.

Referring now to FIGS. 1 and 2, the fuse adapter 40 may have a generally block-shaped outer housing 42 molded of an electrically nonconductive plastic. The housing 42 provides left and right sides 43 and 44 that are coplanar with left side 20 and right side 22 of the terminal block relay 10 when the fuse adapter 40 is attached to the terminal block relay 10.

Joining the left and right sides 43 and 44 of the housing 42 are opposed terminal wall 44 and conductive extension wall 46, and opposed front and rear wall 48 and 50, respectively, each named according to the orientation of the fuse adapter 40 when it is engaged with the terminal block relay 10.

Passing out of the extension wall 46 is a conductive extension 52 that may be received by terminal 24 of the terminal block relay 10. Specifically, the conductive extension 52 fits into a stirrup 56 of the terminal 24 and is pulled against an internal conductor 54 by one wall of the stirrup 56 which compresses the extension 52 against the internal conductor 54 driven by action of a captive screw 30. Such screw terminals 24 are well known in the art.

The conductive extension 52 as held by the extension wall 46 also extends into the housing 42 of the fuse adapter 40 to connect to a first socket 60 positioned near the rear wall 50. Socket 60 provides a spring clamp sized to receive one end cap 62 of a standard electrical fuse 64. Positioned within the opposite side of the housing 42 near front wall 48 of the housing is a second socket 66 for receiving the second end cap 68 of the fuse 64. The fuse 64 is thus held along an axis extending generally from the front to the back of the terminal block relay 10 when the fuse adapter 40 is installed.

The socket 66 connects to internal conductor 70 which is received within a stirrup 72 of a terminal 74 similar to terminal 24. A screw 76, accessible through the front wall 48 of the housing 42, may tighten the stirrup 72 to compress the internal conductor 70 into electrical contact with an external wire 26 inserted into the stirrup 72. Alternatively, a screwless type clamp, well known in the art, may be used A front facing indicator lamp 82, preferably a light emitting diode (LED) or neon lamp, is connected in parallel across sockets 66 and 60 with one lead of the lamp 82 connecting through resistor 84 to socket 60 and a second lead connecting directly to socket 66. When the fuse 64 is absent or open, the application of a voltage across the extension 52 and terminal 74 will cause the lamp 82 to light indicating the fuse 64 needs to be replaced. Such a circuit is adequate for low voltage AC and DC applications and may be modified as is understood in the art for higher voltage applications or polarity sensitive applications.

In the preferred embodiment, an insertion direction 85 along which the external wire 26 is inserted into the terminal 74 will be the same as the insertion direction along which the extension 52 is inserted into the terminal 24. In addition, the screw 76 is accessible by a screwdriver 90 in the same direction as the screws 30 of the other terminals (as shown in FIGS. 2 and 4). In this way, the orientation of external wiring is not significantly altered when the fuse adapter 40 is added.

Referring now to FIG. 3, the housing 42 may include a door 86 that may hinge to an open position (shown in phantom) to allow access to the fuse 64 for replacement. The door may be hinged by means of a living hinge formed in the plastic of the housing 42. As will be understood, the orientation of the fuse 64 allows the height of the fuse adapter 40 measured away from the terminal block relay 10 to be minimized reducing torque on the extension 52. The surface of the extension 52 such as engages the stirrup 56 and/or the internal conductor 54 of terminal 24 of the terminal block relay 10 may include a series of sharpened ridges 53 or embossment to present slippage between these surfaces.

Referring now to FIG. 4, preferably, the wire 26 is attached to the fuse adapter 40 before the fuse adapter 40 is attached to the terminal block relay 10. In this way, any twisting by screwdriver 90 on the housing 42 is not transmitted to the connection between the fuse adapter 40 and the terminal block relay 10.

Twisting of the fuse adapter 40 caused by the external wire 26 may be absorbed by the abutment of surfaces of the housing 42 of the fuse adapter 40 and the housing of the terminal block relay 10. Preferably, at least two perpendicular surfaces, for example, the conductive extension wall 46 and the rear wall 50 of the fuse adapter 40 may abut corresponding surfaces on the terminal block relay 10. The extension 52 holds these surfaces tightly against the terminal block relay 10 allowing these abutting surfaces to convert torque to the housing 42 to tension on the conductive extension 52 which is more readily accommodated by the terminal 24.

The housing 42 of the fuse adapter 40 may further include a key section 92 interfitting within a keyway 94 such as may be intentionally added to the terminal block relay 10 or may be fortuitously existing for other purposes, in this case, for a jumper connector channel. The housing 42 may also include a post on the rear surface interfitting with the opening of the terminal block relay screw terminal below.

It is specifically intended that the present invention not be limited to the embodiments and illustrations contained herein, but include modified forms of those embodiments including portions of the embodiments and combinations of elements of different embodiments as come within the scope of the following claims.

We claim:

1. An in-plane fuse adapter used with a terminal block relay of a type mountable at a rear surface on a laterally extending rail to present a substantially constant lateral thickness between left and right planar walls that may abut corresponding planar walls of adjacent terminal blocks mounted on the rail, the terminal block relay further providing a plurality of terminals accessible at upper and lower edges of the terminal block relay for receiving electrical conductors communicating electrical signals to a relay of the terminal block relay, the fuse adapter comprising:

an insulating housing;

a fuse holder within the insulating housing having a first and second socket receiving corresponding ends of a standard electrical fuse;

a conductive extension having a first end within the housing attached to the first socket, and a second end extending from the housing in an engagement direction to be received and retained by a terminal of the terminal block relay; and a wire terminal held by the housing and attached to the second socket positioned to receive and retain an external electrical conductor of a type normally received by the plurality of terminals of the terminal block relay;

wherein when the conductive extension is retained by a terminal of the terminal block relay, the housing lies substantially between planes of the left and right planar walls of the terminal block relay.

2. The in-plane fuse adapter of claim 1 wherein when the conductive extension is retained by the terminal of the terminal block relay, the fuse adapter has left and right planar walls that are co-planar with the left and right planar walls, respectively, of the terminal block relay.

3. The in-plane fuse adapter of claim 1 wherein the housing includes at least two surfaces that are not parallel to each other and that abut corresponding surfaces of the terminal block relay to resist torsion of the fuse adapter with respect to the terminal block relay when the conductive extension is retained by the terminal of the terminal block relay.

4. The in-plane fuse adapter of claim 1 wherein the housing includes a key portion fitting within a corresponding keyway on the terminal block relay to resist torsion of the fuse adapter with respect to the terminal block relay.

5. The in-plane fuse adapter of claim 1 wherein the wire terminal is positioned within the housing to receive the external electrical conductor along the engagement direction.

6. The in-plane fuse adapter of claim 1 wherein the wire terminal operates to releasably retain the electrical conductor.

7. The in-plane fuse adapter of claim 1 wherein the wire terminal is selected from the group consisting of :a screw and clamp terminal and a screwless clamp.

8. The in-plane fuse adapter of claim 1 wherein the extension includes surface embossments to resist slippage of the extension when retained by the terminal of the terminal block relay.

9. The in-plane fuse adapter of claim 1 wherein the housing includes an opening providing access to the fuse holder.

10. The in-plane fuse adapter of claim 1 wherein the first and second socket are opposed about an axis perpendicular (or at an angle) to the extension direction and parallel to the left and right planar walls of the terminal block relay when the conductive extension is retained by a terminal of the terminal block relay.

11. The in-plane fuse adapter of claim 1 wherein the substantially constant lateral thickness is substantially from 5 to 8 mm.

12. The in-plane fuse adapter of claim 1 further including an indicator lamp connected electrically in parallel with the sockets to light when the fuse is absent or open.

13. The in-plane fuse adapter of claim 12 wherein the indicator lamp is selected from the group consisting of a light emitting diode and a neon lamp.

14. The in-plane fuse adapter of claim 12 wherein the lamp is exposed through the housing along a front edge of the housing opposite to the rail when the conductive extension is retained by the terminal of the terminal block relay.

15. A terminal block relay comprising:

a housing having a rear surface including a channel allowing the housing to be mounted on a laterally extending rail to present a substantially constant lateral thickness between left and right planar walls that may abut corresponding planar walls of adjacent terminal blocks mounted on the rail;

a plurality of terminals accessible at upper and lower edges of the terminal block relay for receiving electrical conductors communicating electrical signals to a relay of the terminal block relay;

an in-plane fuse adapter including:

(a) an insulating housing;

(b) a fuse holder within the insulating housing having a first and second socket receiving corresponding ends of a standard electrical fuse;

(c) a conductive extension having a first end within the housing attached to the first socket and a second end extending from the housing in an engagement direction to be received and retained by a terminal of the terminal block relay; and (d) a wire terminal held by the housing and attached to the second socket positioned to receive and retain an external electrical conductor of a type normally received by the plurality of terminals of the terminal block relay;

wherein when the conductive extension is retained by a terminal of the terminal block relay, the housing lies substantially between planes of the left and right planar walls of the terminal block relay.

* * * * *